US006405800B1

(12) United States Patent
Walker et al.

(10) Patent No.: US 6,405,800 B1
(45) Date of Patent: Jun. 18, 2002

(54) METHOD AND APPARATUS FOR CONTROLLING FLUID FLOW IN A WELL

(75) Inventors: David Joseph Walker, Lafayette, LA (US); DeWayne Turner, Tomball; Marvin Bryce Traweek, Houston, both of TX (US)

(73) Assignee: OSCA, Inc., Lafayette, LA (US)

( * ) Notice: Subject to any disclaimer, the term of this patent is extended or adjusted under 35 U.S.C. 154(b) by 0 days.

(21) Appl. No.: 09/489,179

(22) Filed: Jan. 21, 2000

Related U.S. Application Data

(60) Provisional application No. 60/116,619, filed on Jan. 21, 1999.

(51) Int. Cl.[7] ..... E21B 43/04; E21B 43/08

(52) U.S. Cl. ..... 166/278; 166/51; 166/235

(58) Field of Search ..... 166/51, 157, 205, 166/235, 276, 278

(56) References Cited

U.S. PATENT DOCUMENTS 5,332,039 A * 7/1994 Primeaux et al. ..... 166/278
5,865,251 A * 2/1999 Rebardi et al. ..... 166/278
5,868,200 A * 2/1999 Bryant et al. ..... 166/51
5,975,205 A * 11/1999 Carisella ..... 166/278

* cited by examiner

*Primary Examiner*—David Bagnell
*Assistant Examiner*—Jennifer R. Dougherty
(74) *Attorney, Agent, or Firm*—Baker Botts L.L.P.

(57) ABSTRACT

A method and apparatus for controlling fluid flow in a well bore is provided. A base pipe having an outer surface and an inner bore is provided. A first screen jacket is placed therearound. A second screen jacket is positioned adjacent the first screen jacket around the base pipe. An annular space is defined between the outer surface of the base pipe and each screen jacket. A sleeve is disposed between the adjacent screen jackets and an isolated fluid flow path is created between the annular space defined by the first screen jacket and the annular space defined by the second screen jacket.

20 Claims, 4 Drawing Sheets

METHOD AND APPARATUS FOR CONTROLLING FLUID FLOW IN A WELL

CONTINUATION STATEMENT

This application claims the benefit of U.S. Provisional Application No. 60/116,619, filed Jan. 21, 1999.

BACKGROUND OF THE INVENTION

The present invention relates to methods and apparatus for controlling the flow of fluid in a well bore. More particularly, the invention provides a system for creating a flow path between adjacent screen jackets installed in a well bore.

In the prior art, for example, there are well bore operations which require the downhole placement of material, often via a fluid slurry, in the gap between the exterior of the screen jackets and the casing of the well bore. In order to ensure the reliability of the operation and placement of material in the gap, it is necessary to provide for the subsequent recovery of the fluid comprising the slurry. This may be accomplished by placing a port through the base pipe supporting the screen jacket. Fluid flows through the screen jackets and along the exterior of the base pipe to the port, where it flows into the inner bore of the base pipe for recovery from the well bore. The present invention provides a system that may be installed between adjacent screen jackets, thereafter providing a flow path between the adjacent screen jackets to the port while inhibiting flow to the inner bore of the base pipe.

Certain disadvantages have been identified with systems in the prior art. Typically, to obtain optimal results while performing various completion operations within the well bore, such as, for example, gravel packing, well stimulation, hole cleaning, or frac packing, it is desirous to provide some amount of fluid to return through the screen; from the area outside the screen jacket to the inner bore of the base pipe. In the prior art, a port is installed through the wall of the base pipe supporting the screen jacket. Preferably, the port is placed on the screen jacket positioned at the bottom of the production zone. The port allows fluid communication from the annular space outside the screen jackets to the inner bore of the base pipe. A wash pipe placed within the inner bore of the base pipe returns the fluid to the top of the well bore. Thus, a flow path is created from the annular space exterior the screen jackets through the screen jackets along the exterior surface of the base pipe. Fluid flows through the port and into the inner bore of the base pipe, where fluid is returned through the wash pipe to the top of the well bore.

It has been found that in some completion operations, such as gravel packing, for example, the area exterior of the screen jacket and the casing of the well bore (or walls of an open hole well) becomes filled with gravel. When a number of screen jackets are positioned above the port, the gravel placed in the well bore sequentially fills the gap between the top and bottom joints of adjacent screen jackets. Since there is typically a gap of about one to two feet between these joints, resistance is created to prevent or limit fluid flow between adjacent screen jackets due to material filling the gap between the base pipe and the casing (or walls of an open hole.) This affects the success and reliability of the treatment being performed in the well.

The prior art addresses this problem by either providing multiple ports uphole from the bottom port or increasing the pressure differential across the screen jackets. These solutions suffer from the drawbacks of being unreliable and/or increasing the complexity of well bore operations.

There therefore remains a need for a method and apparatus for controlling the flow of fluid during well completion operations by providing a flow path between adjacent screen jackets. The system should also isolate the inner bore of the base pipe from the flow of fluids to prevent contamination of the base pipe. The system should be reliable, safe, economical, and easy to install and operate within the well bore. The present invention satisfies these needs, among others.

SUMMARY OF THE INVENTION

The present invention provides an apparatus for coupling two adjacent screens to form an isolated fluid path therebetween.

The present invention further includes a method for coupling multiple screen assemblies. The method includes providing at least two screen assemblies mounted on a base pipe and coupling the assemblies to create an isolated fluid path between the screens.

In one aspect of the invention, an apparatus for controlling the flow of fluid in a well bore is provided. The apparatus includes an upper tubing section and a lower tubing section, each having a proximal end and a distal end. Each tubing section has a base pipe defining a bore, and each base pipe has an inner surface and an opposite outer surface extending between the proximal and distal ends of the tubing section. Each base pipe further includes an end portion, with the upper base pipe having the end portion at its distal end and the lower base pipe having the end portion at its proximal end. Each end portion defines at least one aperture communicating between the inner and outer surfaces of the base pipe. Each well section further includes a screen jacket positioned about the base pipe, the screen jacket and the outer surface of the base pipe defining an annular space therebetween. A sleeve is disposed between the upper and lower tubing sections to define an isolated flow path between the apertures, providing fluid communication between the annular space of the upper well section and the annular space of the lower well section.

Preferably, the end portion of each base pipe includes an end connector for engaging adjacent base pipe. In another preferred aspect, the sleeve sealingly engages the inner surface of the end connectors and isolates the bore of the base pipe from the fluid. In a further preferred aspect, each of the end connectors defines a recessed portion on its inner surface, and the sleeve engages the end connectors along the recessed portion so that the bore of the base pipe is substantially unobstructed by the sleeve. Preferably, the upper tubing section is engaged to the lower well section via a mechanical coupling.

In another aspect of the present invention, a method for controlling the flow of fluids within a well bore is provided. The method includes providing a base pipe having an outer surface and an inner bore and providing a first screen jacket and a second screen jacket positioned adjacent one another around the base pipe, each screen jacket defining an annular space between the outer surface of the base pipe and the screen jacket. A fluid flow path is created between the annular space defined by the first screen jacket and the annular space defined by the second screen jacket. Preferably, the inner bore of the base pipe is isolated from the fluid flow path.

In yet another aspect of the present invention, a method for controlling the flow of fluid between adjacent sections of tubing is provided. The method includes providing a first tubing section having a first base pipe defining a first bore and having an inner surface and an opposite outer surface, the first base pipe further including a first end portion at one end thereof, the fist end portion defining a first aperture communicating between the inner and outer surfaces. The first tubing section is assembled by placing a first screen jacket about the first base pipe, the first screen jacket and the outer surface of the first base pipe defining a first annular space. The method further includes providing a second tubing section having a second base pipe defining a second bore and having an inner surface and an opposite outer surface, the second base pipe further including a second end portion at one end thereof engaged in abutting relation with the first end portion, the second end portion defining a second aperture communicating between the inner and outer surfaces. The second tubing section includes a second screen jacket placed about the second base pipe, the second screen jacket and the outer surface of the second base pipe defining a second annular space. The method includes placing a sleeve in the first and second bores to create a flow path between the first annular space and the second annular space through the first and second apertures while isolating the first and second bores from fluid flow.

In still another aspect of the present invention, fluid may be returned to the top of the well through the base pipe port by the base pipe positioned at the bottom of the base pipe assembly. Fluid is returned through the port from the exterior of the screen jackets by flowing the fluid through the screen jackets into the annular space between the base pipe and the screen jacket. Fluid flows downward to the port through the annular spaces defined by the screen jackets positioned above the port.

According to a further aspect of the invention, there is provided an apparatus for controlling fluid flow in a well, the apparatus comprising: a primary screen; a primary base pipe within the primary screen, wherein a primary space is defined by the primary screen and the primary base pipe; at least one secondary screen; a secondary base pipe within the at least one secondary screen, wherein a secondary space is defined by the at least one secondary screen and the secondary base pipe; and a flow path between the primary space and the secondary space.

According to a further aspect of the invention, there is provided an apparatus for controlling fluid flow in a well, the apparatus comprising: a primary screen; a primary base pipe within the primary screen, wherein a primary space is defined by the primary screen and the primary base pipe; at least one secondary screen; a secondary base pipe within the at least one secondary screen, wherein a secondary space is defined by the at least one secondary screen and the secondary base pipe; and a flow path between the primary space and the secondary space, wherein the primary base pipe and the secondary base pipe are connected and a sleeve is positioned within and substantially concentric with the primary and secondary base pipes, whereby the flow path is defined by the primary and secondary base pipes and the sleeve, wherein the flow path further comprises at least one primary aperture in the primary base pipe and at least one secondary aperture in the secondary base pipe; a port in the primary base pipe between the primary space and an inner bore of the primary base pipe; and a valve which opens and closes the port in the primary base pipe.

According to still another aspect of the invention, there is provided a method for controlling fluid flow in a well, the method comprising: flowing fluid from an exterior of at least one secondary screen to a secondary space defined by the at least one secondary screen and a secondary base pipe; and conducting the fluid of the flowing from the secondary space to a primary space defined by a primary screen and a primary base pipe.

Further objects and advantages of the present invention will be apparent from the description of the preferred embodiment that follows.

DETAILED DESCRIPTION OF THE INVENTION

Figure 1:
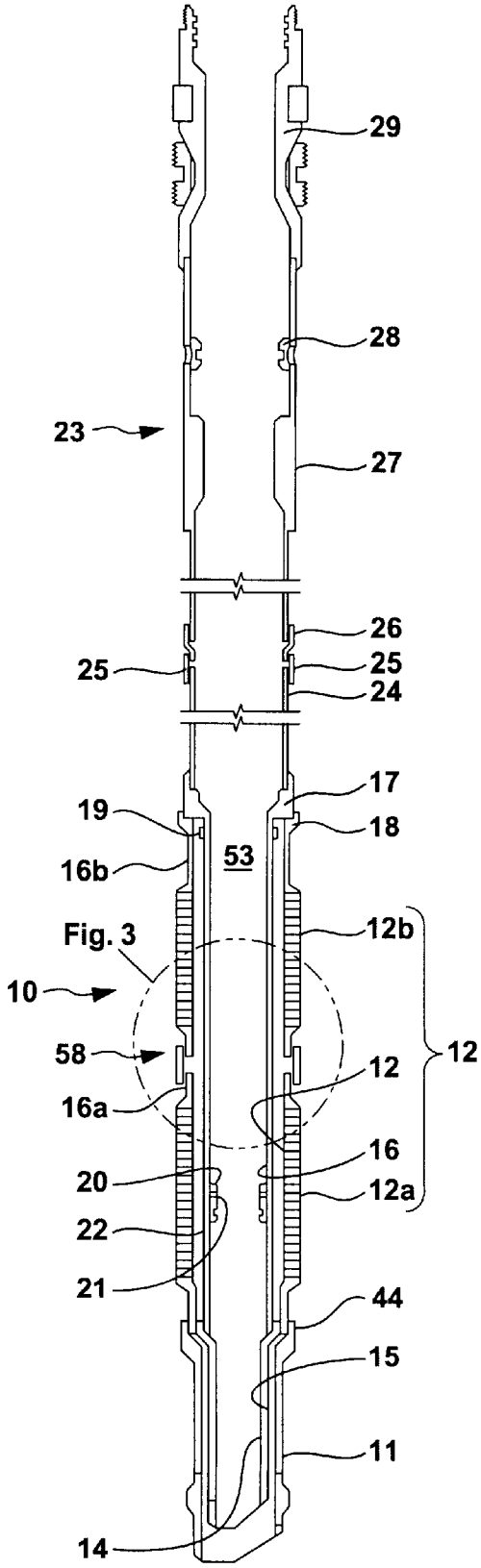
FIG. 1 is a side, cross-sectional, diagrammatic view of an isolation system and gravel pack assembly that may be used with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In accordance with the present invention, a method and apparatus is provided for controlling the flow of fluids in a well bore. The system provides a fluid flow path between adjacent screen jackets positioned in the well bore when the screen jackets are mounted to a base pipe. Preferably, the system isolates the inner bore of the base pipe from the flow of fluid between adjacent screen jackets.

In the preferred embodiment, a sleeve is placed within the base pipe at or adjacent the joint defined between adjacent screen jackets (also known as the joint between an upper screen jacket and a lower screen jacket, or a joint between a first screen jacket and a second screen jacket.) The sleeve has an upper seal and a lower seal movably engaging the inner walls of the base pipe. In an alternate embodiment, the sleeve may be fixed to the base pipe. The base pipe includes an upper aperture and a lower aperture formed through the wall of the base pipe, the upper aperture and the lower aperture being positioned between the upper and lower seals of the sleeve, respectively. A flow path is created between the outside surface (or outside diameter) of the sleeve and the inside surface (or inside diameter) of the base pipe. Thus, fluid communication is provided via the flow path from the upper annular space between the upper screen jacket and the base pipe to the lower annular space between the lower screen jacket and the base pipe.

The fluid flow control system of the present invention is useful in connection with conventional well bore systems. The present invention is particularly useful for providing a fluid flow path between adjacent screen jackets when the gap or annular space between the base pipe and the well casing (or open hole) is filled with proppant, sand, gravel, or other material that resists fluid flow in the area adjacent the joint between adjacent screen jackets. The system for controlling fluid flow in a well bore of the present invention may also be configured in a variety of ways to accomplish this purpose.

FIG. 1 shows an isolation/screen assembly 10 incorporated into an overall gravel packer assembly 23. The isolation/screen assembly 10 includes a locator seal 11 with an exterior concentric seal assembly 44. The seal assembly 44 is threaded to the distal or lower end of the screen jackets assembly, collectively designated as screen jackets 12. Each screen jacket 12 is coupled to a corresponding section of base pipe, collectively designated as base pipe 16.

Received within seal 11 is collet 14 having external concentric seal assemblies 15 providing a fluid tight seal with seal 11 at the distal end of isolation/screen assembly 10. Collet 14 is threaded to base pipe 16. Base pipe 16 is in turn secured to a coupling 17 by means of collars 18 and 19, respectively, threaded to the coupling 17. Therefore, the screen jacket assembly 10 is sealed on both its proximal and distal ends, and fluid communication from the exterior of the screen jackets 12 to the interior or inner bore 53 of the base pipe 16 is controlled by the base pipe 16.

A valve member 20 that is received within and movably mounted to base pipe 16. Valve member 20 defines at least one aperture 21, which is alignable with one or more ports 22 through the base pipe 16, thereby providing fluid communication therewith when aperture 21 is aligned with port 22. Valve member 20 has an open position with aperture 21 in fluid communication with port 22, permitting fluid to pass from the exterior of screen jackets 12 through the screens to the interior of base pipe 16. This valve member 20 also has a closed position in which aperture 21 is not in fluid communication with port 22. A closed position of the valve member 20 combines with the proximal end connections at coupling 17 and the distal sealing connections by the seal assemblies 15 to prevent fluid communication from the exterior of the screen jackets 12 to inner bore 53 of the base pipe 16.

In typical use, the isolation/screen system 10 may be incorporated in an overall gravel packing assembly 23 also shown in FIG. 1. Coupling 17 is threadedly coupled through a blank pipe 24 and collar 25 to a shear out safety joint 26. The joint 26 is in turn coupled by threaded engagement to a lower seal bore 27, perforated extension 28 and gravel packer 29. In conventional fashion, gravel packer 29 includes a threaded proximal end for receiving a complimentary hydraulic setting tool (not shown).

Figure 2:
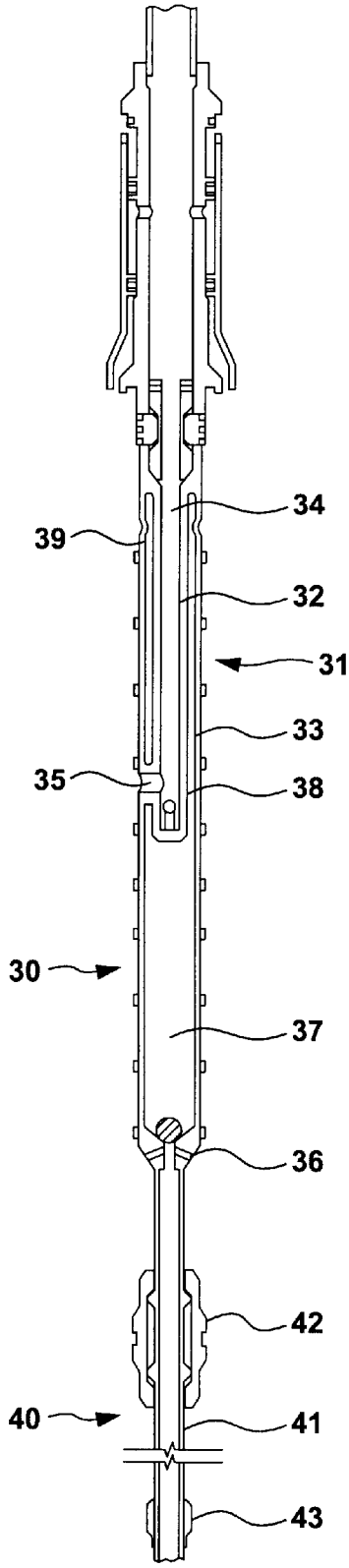
FIG. 2 is a side, cross-sectional, diagrammatic view of a service tool and service string assembly that may be used with the present invention.

Useful with the isolation/screen jacket system 10 and gravel packing assembly 23 is the service tool and service string assembly 30 shown in FIG. 2. The overall service tool/string assembly 30 includes a crossover assembly 31. The crossover assembly 31 provides control of fluid flow in cooperation with other components inserted into the well bore. The crossover assembly 31 includes an inner pipe 32 that extends for a portion of the proximal part of an outer pipe 33. Inner pipe 32 defines a central lumen 34 that communicates through aperture 35 to the exterior of outer pipe 33 at a location intermediate the length of the outer pipe 33. In addition, outer pipe 33 defines a plurality of apertures 36 which communicate from the exterior of the outer pipe 33 at its distal end to an interior chamber 37, which in turn communicates through an annular portion 38 and holes 39 to the exterior of the outer pipe at its proximal end. Thus crossover assembly 31 allows delivery of fluids into the well bore to perform, for example, completion operations at screen assembly 10 and provides for the subsequent return of fluids therefrom.

Extending distally from the crossover assembly 30 is a service string 40 that operates in cooperation with isolation system 10. Service string 40 includes a cylindrical member 41 which carries a position indicator 42 and a multi-action shifting tool 43. Position indicator 42 works in conjunction with lower seal bore 27 (FIG. 1) and is useful for indicating the position of shifting tool 43. The shifting tool 43 is operable with valve member 20 on isolation pipe 16 to move valve member 20 between opened and closed positions.

The isolation/screen jacket assembly 10, gravel pack assembly 23, and the service tool/string assembly 30 are assembled using conventional techniques, and are used in combination to establish a well bore gravel pack system having enhanced operating capabilities. The overall system is operable in several different modes, including squeezing, circulating, reversing and production, as described more fully in U.S. Pat. No. 5,609,204 to Rebardi, et al., which patent is hereby incorporated by reference.

Figure 3:
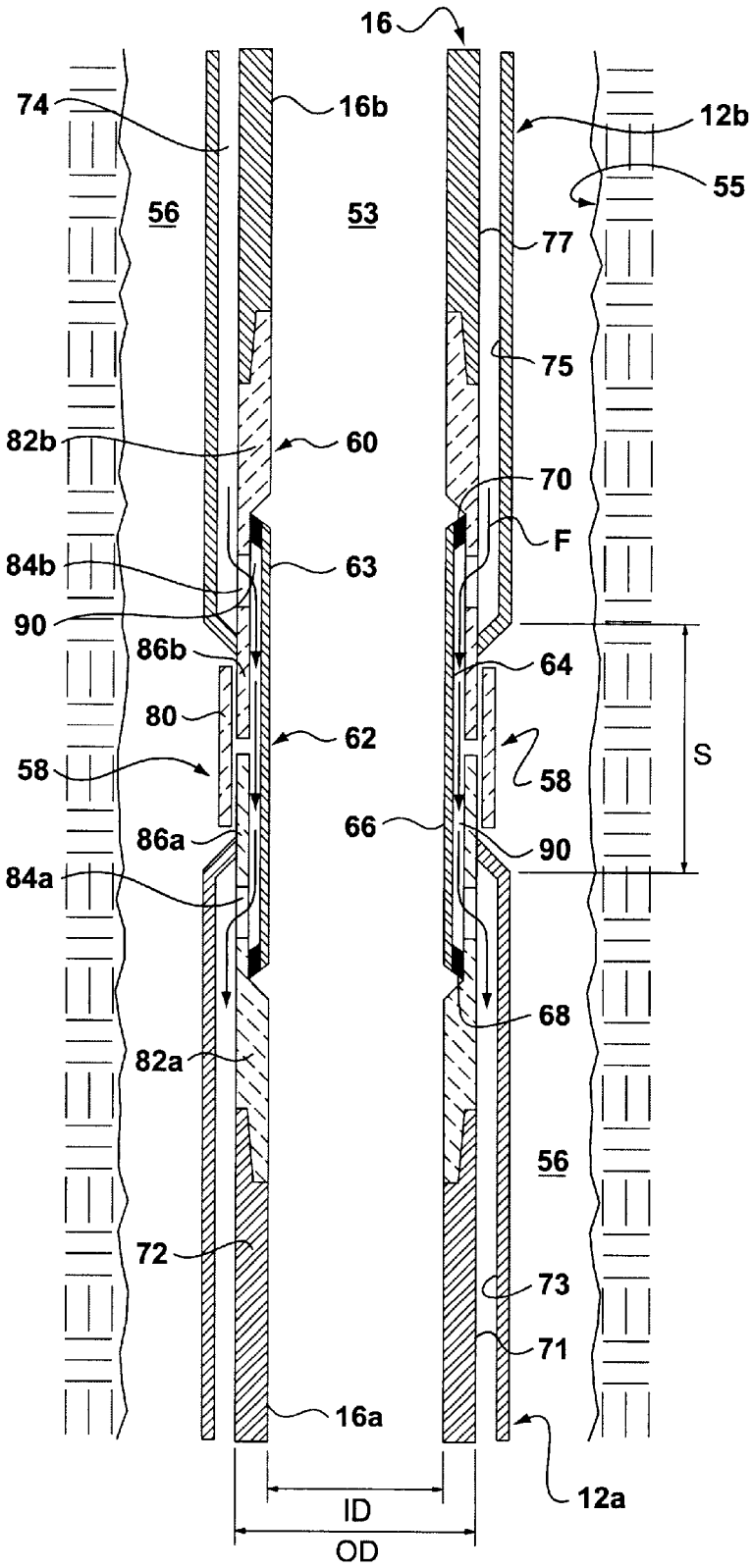
FIG. 3 is a side, cross-sectional, diagrammatic view of an enlarged portion of FIG. 1 illustrating an apparatus for providing a fluid flow path between adjacent screen jackets in a well environment.

Referring now to FIG. 3, there is shown a detailed view of an apparatus for controlling the flow of well fluids in accordance with the present invention. FIG. 3 shows an enlarged view of the coupling between screens 12*a* and 12*b*, in the well environment. Apparatus 60 comprises a sleeve 62 having a body 63 with an outer surface 64 and an opposite inner surface 66. A lower seal 68 and an upper seal 70 are positioned at the lower end and the upper end of sleeve 62, respectively. The screen jackets 12*a* and 12*b* may likewise be designated as the lower screen jacket 12*a* and the upper screen jacket 12*b*. The sleeve 62 is sized to span between at least the distance S defined by joint 58 between adjacent screen jackets 12*a*, 12*b*. Typically, the distance S is in the range of about one to two feet although shorter or longer distances are contemplated. Adjacent base pipe sections 16*a* and 16*b* extend beyond the adjacent screen jackets 12*a* and 12*b*, and are engaged via mechanical coupling 80. However, it should be appreciated that the present invention also contemplates a base pipe 16 that is continuous between adjacent screen jackets 12*a* and 12*b*.

It should be understood that in the lowermost screen jacket 12*a* of the assembly 10, there is provided port 22 through base pipe 16 in fluid communication with inner bore 53 (FIG. 1). Screen jacket 12*a* and base pipe section 16*a* define lower annular space 72 between the outside diameter (OD) or exterior surface 71 of the base pipe 16*a* and inner surface 73 of lower screen jacket 12*a*. Likewise, base pipe 16*b* and upper screen jacket 12*b* define upper annular space 74 between the exterior surface 77 or outside diameter (OD) of base pipe 16*b* and inner surface 75 of upper screen jacket 12*b*. It should be appreciated that base pipe sections 16*a* and 16*b* are engaged via mechanical coupling 80, which may be threaded or similarly configured as is known in the art. In one embodiment, base pipe 16*a* includes lower end connector 82*a*, and base pipe 16*b* includes upper end connector 82*b*. End connector 82*a* defines lower aperture 84*a*, and end connection 82*b* defines upper aperture 84*b*. It should be understood that apertures 84*a* and 84*b* comprise at least one opening through the wall of the base pipe and/or end connector, and that apertures 84*a*, 84*b* may comprise a plurality of openings being of the same or differing size.

Sealing sleeve 62 is positioned between end connectors 82*a*, 82*b* such that lower aperture 84*a* and upper aperture 84*b* are positioned between lower seal 68 and upper seal 70, respectively. Sealing sleeve 62 is sized such that a flow path 90 (designated by arrow F) is created between the outside surface 64 of sealing sleeve 60 and the inside surface of end connectors 82*a* and 82*b*. Thus, fluid may flow from upper annular space 74 through upper aperture 84*b* into flow path 90, then through lower aperture 84*a* into lower annular space 72. While annular spaces 72 and 74 are shown for the purposes of illustration, it will be understood that in some application, the flow path may extend directly through the screen material and that no annulus is required. It should be appreciated that the path 90 is provided even though the space 56 between casing 55 and base pipe 16 at joint 58 completely fills with sand or other material resisting fluid flow therethrough.

In one form of the invention the end connectors 82*a*, 82*b* have recessed portions 86*a*, 86*b*, respectively. Recessed portions 86*a* and 86*b* allow the sleeve 62 to be positioned within bore 53 while maintaining a constant inner diameter (ID) of the base pipe 16. Apparatus 60 includes lower seal 68 positioned below aperture 84*a* and upper seal 70 positioned above aperture 84*b* engaged to sleeve 62. Seals 68 and 70 prevent fluid from reaching the inside diameter (ID) of the base pipe 16, thus providing isolation between the exterior of the screen jacket and the inner diameter of base pipe 16. Thus, an isolated flow path between adjacent screens is created. In one embodiment, seals 68 and 70 are o-ring seals made from an elastometric or rubber material, and allow the sleeve 60 to float inside base pipe 16 within the recessed portions of end connectors 82*a* and 82*b*.

Preferably, the end connectors 82*a*, 82*b* are provided with threads adjacent recessed areas 86*a*, 86*b* to threadedly couple end connectors 84*a*, 84*b* in end to end relation by use of a corresponding internally threaded coupler 80. In a preferred method of assembling the isolation assembly 10, the base pipes 16 are provided with screen jackets 12 engaged thereto in conventional manner. A first tubing section includes a first screen jacket 12*a* and base pipe 16*a* assembly. The base pipe assembly may be provided with an end connector 82*a* having a first aperture 84*a*. Alternatively, the base pipe and end connector may be an integral unit. The sleeve 62 along with seals 68, 70 are placed within bore 53 of the first well section such that lower seal 68 is positioned below first aperture 84*a*. A second tubing section includes second screen jacket 12*b*, base pipe 16*b* assembly including an end connector 82*b* having a second aperture 84*b*. The second tubing section is positioned around sleeve 62 in end-to-end relation with the first tubing section such that first aperture 84*a* is adjacent second aperture 84*b*. The first and second well sections are then threadingly engaged via coupling. While only the connection between two adjacent screens has been shown, it is contemplated that multiple screens may be joined in a like manner.

It should be appreciated that fluids may be circulated through the well bore system of the present invention such that slurries and/or other fluids placed through gravel pack assembly 23 may be circulated through central lumen 34 of crossover assembly 31, out through port 28 into the annular gap 56 space between the exterior of screens 12 and casing 55 (FIG. 3) of the well bore. It should also be appreciated that the present invention may also be used in open-hole wells that do not include a casing 55. The fluid may then pass through screen jackets 12, which filters solid material from the slurry, and into annular spaces 72, 74. Fluid is returned from the upper screen jackets via flow path 90 to port 22. When valve 20 is open, fluid flows through port 22 and aperture 21 to inner bore 53. The fluid then moves upwardly past location indicator 42 and into crossover assembly 31. Fluid then flows through annular portion 38 and out holes 39 into the annular region outside and above the hydraulic tool.

It will be appreciated that the assembly described above is useful for delivering well bore fluids, such as completion fluids, to the region, space or gap between screen jackets 12 and casing 55. As is conventional in some well completion applications, slurry is delivered to fill the area outside the screen jackets 12 with material up to a level at least slightly above the top of the screen assembly 10. Oftentimes, there are multiple screen jackets 12 positioned adjacent one another in the well. In FIG. 1, there are shown only two screen jackets 12*a* and 12*b*. However, it should be understood that the present invention contemplates use of any number of screen jackets 12 in the isolation/screen jacket assembly 10.

When more than one screen jacket 12 is used, slurry or other fluid may be delivered to the well bore to completely fill gap 56 to cover two or more screen jackets 12. The exterior area adjacent joint 58 between adjacent screens 12*a* and 12*b* fills with, for example, sand or gravel and thus completely fills the space or gap 56 between the exterior of base pipe 16 and the casing 55 (or walls of an open hole). When this happens, resistance to fluid flow into open port 22 is thereby increased, thus making well completion more difficult and less reliable than completion operations performed on a location that includes only a single screen jacket 12. The present invention provides a flow path 90 between the adjacent screen jackets 12*a* and 12*b* in order to maintain the fluid flow during well completion, even if the annular space gap 56 adjacent joint 58 between the adjacent screen jackets 12*a* and 12*b* is completely filled with material and resists or inhibits fluid flow therethrough. There is also eliminated the need to provide multiple valves and ports at each production screen assembly 10 in order to remove fluid from the gap 56.

It should be appreciated that the isolation/screen jacket assembly 10 and service tool assembly 30 work together to selectively open and close openings 22 through the lowermost base pipe 16 in order to perform packing and well completion operations. This is advantageous over prior art devices in that there is no need to provide multiple valves or ports in isolation assembly 10 at each screen jacket location. It should also be appreciated that the foregoing description relates to a somewhat simplified and diagrammatic view of the isolation system and related components. As is well understood in the art, these components may include a multiplicity of members interconnected in conventional fashion, for example by threaded connection. Also, items shown as a single pipe may comprise several pipes connected together with threaded couplings to provide an overall member of desired length. Likewise, items shown comprising individual elements coupled together may be integrally formed or welded together as understood by those skilled in the art.

Figure 4:
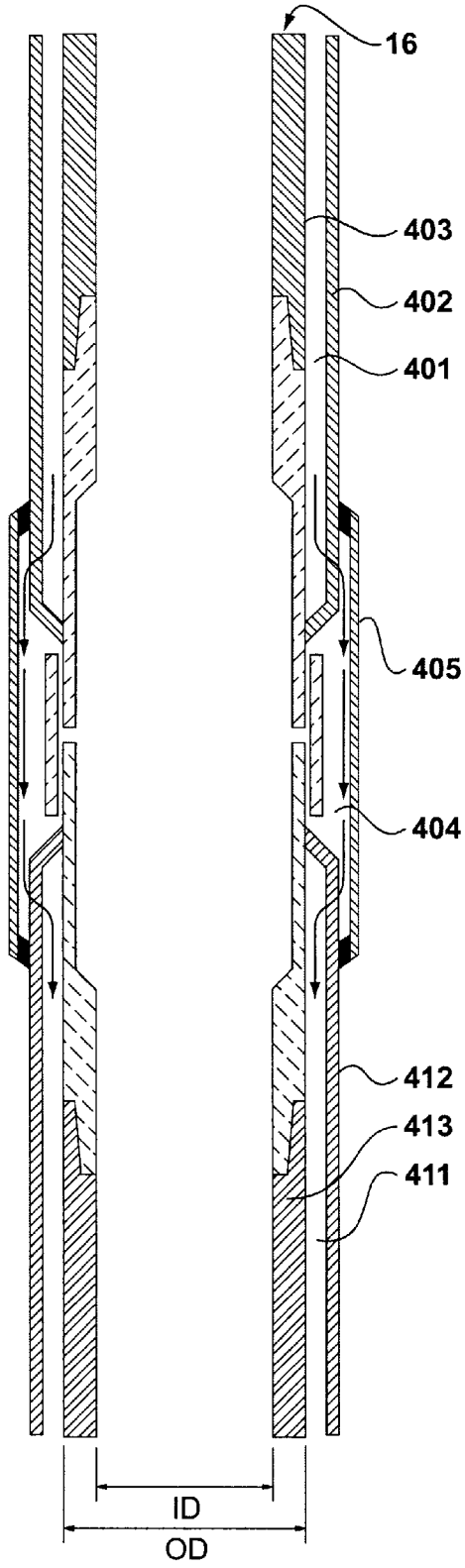
FIG. 4 illustrates an alternative embodiment of the invention having an exterior sleeve.

Referring to FIG. 4, there is shown a secondary space 401 defined by a secondary screen 402 and a secondary base pipe 403. A primary space 411 is defined by a primary base pipe 413 and a primary screen 412. The secondary space 401 is in fluid communication with the primary space 411 by a flow path 404. In this embodiment, the flow path 404 is an annular conduit defined internally by adjacent ends of the secondary and primary base pipes 403 and 413. In alternative embodiments, the base pipes 403 and 413 are made-up, welded, and joined by a section of pipe between. The flow path 404 is defined externally by a sleeve 405 positioned concentrically around the outside of the secondary and primary base pipes 403 and 413. According to alternative embodiments, fluid from the secondary space 401 passes into the flow path 404 through apertures, holes and through pores in the secondary screen 402. In the embodiment which passes fluid through the pores, the sleeve 405 is made to over lap the secondary screen 402 and is sealed to an exterior. Because a portion of the secondary screen 402 is exposed to the flow path 404, fluid is allowed to pass into the flow path 404 through the pores in the screen 402. Similar apertures, holes and pores allow fluid to pass from the flow path 404 into the primary space 411.

Figure 5:
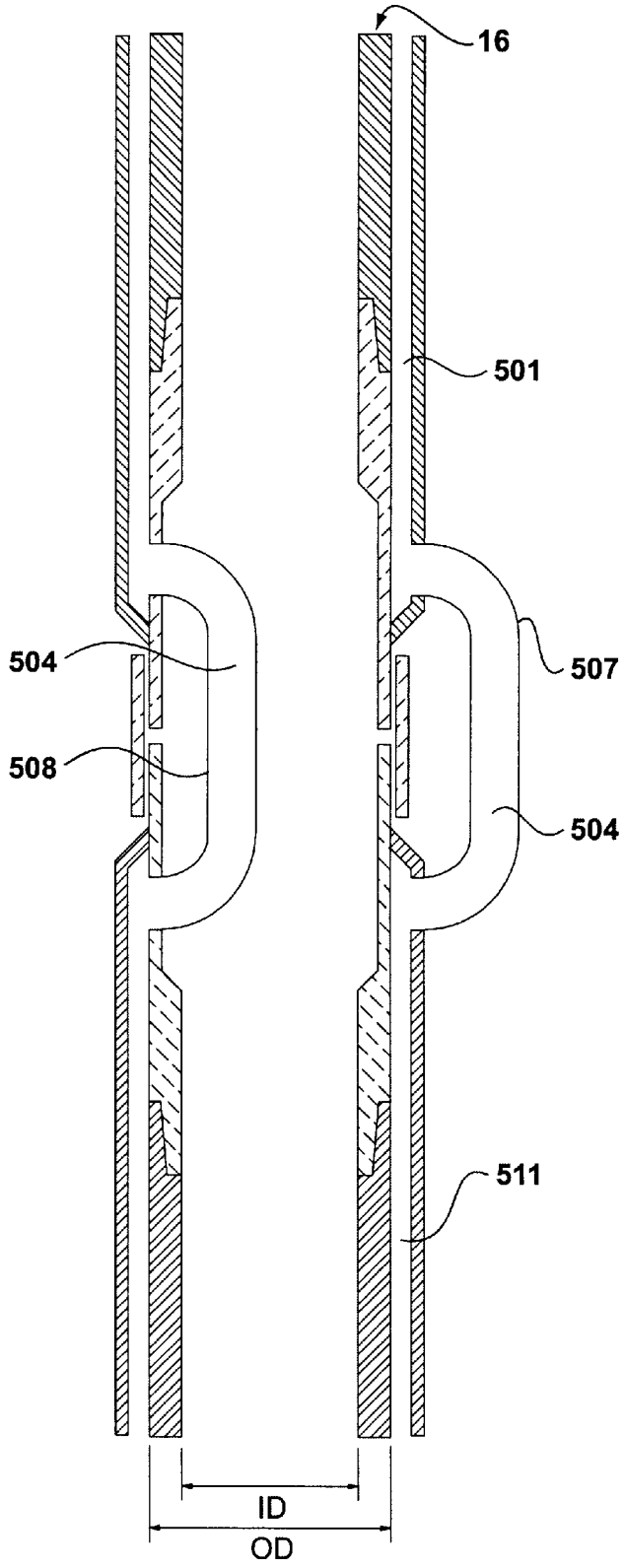
FIG. 5 illustrates an alternative embodiment of the invention having tubes or conduits to define the flow path.

Referring to FIG. 5, there is shown an alternative embodiment of the invention having tubes or conduits to define the flow path. Depending on the particular embodiment, the tubes may extend within or without the base pipes, or both. As shown in FIG. 5, an exterior tube 507 is connected at one end to a secondary space 501 and at the other end to a primary space 511. An interior tube 507 is connected at one end to a secondary space 501 and at the other end to a primary space 511.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for controlling fluid flow in a well during gravel packing, well stimulation, hole cleaning, and/or fracture packing operations, said apparatus comprising:

a primary screen, wherein said primary screen is a gravel slurry solid material filtering screen;

a primary base pipe within said primary screen, wherein a primary space is defined by said primary screen and said primary base pipe;

at least one secondary screen, wherein said secondary screen is a gravel slurry solid material filtering screen;

a secondary base pipe within said at least one secondary screen, wherein a secondary space is defined by said at least one secondary screen and said secondary base pipe; and a flow path between the primary space and the secondary space.

2. An apparatus as claimed in claim 1, wherein said primary screen and said primary base pipe have first and second ends, wherein the first ends of said primary screen and primary base pipe are fluidly sealed together, and wherein the second ends of said primary screen and primary base pipe are fluidly sealed together.

3. An apparatus as claimed in claim 1, wherein said secondary screen and said secondary base pipe have first and second ends, wherein the first ends of said secondary screen and secondary base pipe are fluidly sealed together, and wherein the second ends of said secondary screen and secondary base pipe are fluidly sealed together.

4. An apparatus as claimed in claim 1, further comprising a port in said primary base pipe between said primary space and an inner bore of said primary base pipe.

5. An apparatus as claimed in claim 4, further comprising a valve which opens and closes said port in said primary base pipe.

6. An apparatus as claimed in claim 1, wherein said flow path comprises:

said primary base pipe;

said secondary base pipe, wherein said primary and secondary base pipes are connected; and a sleeve substantially concentric with said primary and secondary base pipes, whereby said flow path is defined by said primary and secondary base pipes and said sleeve.

7. An apparatus as claimed in claim 6, wherein said sleeve is positioned on the outside of said primary and secondary base pipes.

8. An apparatus as claimed in claim 7, wherein said flow path comprises:

at least one primary aperture in said primary screen, wherein said flow path and said primary space fluidly communicate through the at least one primary aperture; and at least one secondary aperture in said secondary screen, wherein said flow path and said secondary space fluidly communicate through the at least one secondary aperture.

9. An apparatus as claimed in claim 8, wherein said primary and secondary apertures comprise a plurality of holes in said primary and secondary screens, respectively.

10. An apparatus as claimed in claim 6, wherein said primary and secondary base pipes are connected by a coupling.

11. An apparatus as claimed in claim 1, wherein said primary and secondary base pipes together comprise a continuous singular base pipe.

12. An apparatus for controlling fluid flow in a well, said apparatus comprising:

a primary screen;

a primary base pipe within said primary screen, wherein a primary space is defined by said primary screen and said primary base pipe;

at least one secondary screen;

a secondary base pipe within said at least one secondary screen, wherein a secondary space is defined by said at least one secondary screen and said secondary base pipe; and a flow path between the primary space and the secondary space, wherein said flow path comprises:

said primary base pipe;

said secondary base pipe, wherein said primary and secondary base pipes are connected; and a sleeve substantially concentric with said primary and secondary base pipes, whereby said flow path is defined by said primary and secondary base pipes and said sleeve, wherein said sleeve is positioned within said primary and secondary base pipes.

13. An apparatus as claimed in claim 7, wherein said flow path comprises:

at least one primary aperture in said primary base pipe, wherein said flow path and said primary space fluidly communicate through the at least one primary aperture; and at least one secondary aperture in said secondary base pipe, wherein said flow path and said secondary space fluidly communicate through the at least one secondary aperture.

14. An apparatus for controlling fluid flow in a well, said apparatus comprising:

a primary screen;

a primary base pipe within said primary screen, wherein a primary space is defined by said primary screen and said primary base pipe;

at least one secondary screen;

a secondary base pipe within said at least one secondary screen, wherein a secondary space is defined by said at least one secondary screen and said secondary base pipe; and a flow path between the primary space and the secondary space, wherein said primary base pipe and said secondary base pipe are connected and a sleeve is positioned within and substantially concentric with said primary and secondary base pipes, whereby said flow path is defined by said primary and secondary base pipes and said sleeve, wherein the flow path further comprises at least one primary aperture in said primary base pipe and at least one secondary aperture in said secondary base pipe;

a port in said primary base pipe between said primary space and an inner bore of said primary base pipe, a valve that opens and closes said port in said primary base pipe.

15. A method for controlling fluid flow in a well during gravel packing, well stimulation, hole cleaning, and/or fracture packing operations, said method comprising:

flowing fluid from an exterior of at least one secondary screen to a secondary space defined by the at least one secondary screen and a secondary base pipe, wherein said secondary screen is a gravel slurry solid material filtering screen; and conducting the fluid of said flowing from the secondary space to a primary space defined by a primary screen and a primary base pipe, wherein said primary screen is a gravel slurry solid material filtering screen.

16. A method as claimed in claim 15, wherein the fluid of said flowing comprises particles and a carrier fluid, wherein said flowing comprises flowing the carrier fluid to the secondary space, whereby the particles are deposited at the exterior to the at least one secondary screen.

17. A method as claimed in claim 15, wherein said conducting comprises conducting the fluid through a flow path between the secondary space and the primary space.

18. A method as claimed in claim 17, wherein said conducting comprises conducting the fluid through a flow path on the outside of the primary and secondary base pipes.

19. A method as claimed in claim 15, further comprising passing fluid from the primary space to an inner bore of the primary base pipe.

20. A method for controlling fluid flow in a well, said method comprising:

flowing fluid from an exterior of at least one secondary screen to a secondary space defined by the at least one secondary screen and a secondary base pipe; and conducting the fluid of said flowing from the secondary space to a primary space defined by a primary screen and a primary base pipe, wherein said conducting comprises conducting the fluid through a flow path between the secondary space and the primary space, wherein said conducting comprises conducting the fluid through a flow path within the primary and secondary base pipes.

* * * * *